US008776443B2

(12) United States Patent
Bienick

(10) Patent No.: US 8,776,443 B2
(45) Date of Patent: Jul. 15, 2014

(54) REFRIGERATED DISPLAY CASE DOOR

(75) Inventor: Craig Bienick, Jenison, MI (US)

(73) Assignee: Gemtron Corporation, Sweetwater, TN (US)

( * ) Notice: Subject to any disclaimer, the term of this patent is extended or adjusted under 35 U.S.C. 154(b) by 952 days.

(21) Appl. No.: 11/525,856

(22) Filed: Sep. 25, 2006

(65) Prior Publication Data

US 2008/0122324 A1 May 29, 2008

(51) Int. Cl.
*E06B 3/58* (2006.01)

(52) U.S. Cl.
USPC ..... 49/501; 49/504; 52/204.62; 52/204.7; 52/208

(58) Field of Classification Search
USPC ..... 49/504, 501; 52/204.62, 204.69, 204.7, 52/208
See application file for complete search history.

(56) References Cited

U.S. PATENT DOCUMENTS

| | | | | |
|---|---|---|---|---|
| 3,499,245 | A | 3/1970 | Winsler et al. | |
| 3,634,971 | A * | 1/1972 | Kesling | 49/460 |
| 3,673,735 | A | 7/1972 | Winsler et al. | |
| 4,127,765 | A | 11/1978 | Heaney | |
| 4,382,177 | A | 5/1983 | Heaney | |
| 4,741,127 | A | 5/1988 | Bockwinkel | |
| 4,831,780 | A | 5/1989 | Bockwinkel | |
| 4,852,303 | A | 8/1989 | Rolek | |
| 4,891,912 | A | 1/1990 | Bockwinkel | |
| 4,948,206 | A | 8/1990 | Fitzpatrick | |
| 4,998,382 | A | 3/1991 | Kostos et al. | |
| 5,024,023 | A | 6/1991 | Kostos et al. | |
| 5,035,085 | A * | 7/1991 | Mamelson et al. | 49/504 |
| 5,255,473 | A * | 10/1993 | Kaspar et al. | 49/501 |
| RE35,120 | E | 12/1995 | Heaney | |
| 5,894,706 | A * | 4/1999 | Herbst | 52/782.1 |
| 5,910,083 | A | 6/1999 | Richardson et al. | |
| 6,606,833 | B2 * | 8/2003 | Richardson et al. | 52/204.5 |
| 6,722,083 | B2 | 4/2004 | Herranann et al. | |
| 6,925,767 | B2 * | 8/2005 | Krochmal et al. | 52/455 |
| 7,334,371 | B2 * | 2/2008 | Rinehart et al. | 52/204.593 |

FOREIGN PATENT DOCUMENTS

EP 1 316 766 A2 6/2003

OTHER PUBLICATIONS

European Search Report dated Dec. 10, 2010 from corresponding EP 07116355.4-1258 /1908376.
European Search Report dated Feb. 13, 2012 for European application No. 07116355.4.
Mexican Office Action dated Feb. 28, 2012 for Mexican application No. MX/a/2007/011800.
Extended European Search Report dated Mar. 21, 2011 for application No. 07116355.4.

* cited by examiner

*Primary Examiner* — Gregory J. Strimbu
(74) *Attorney, Agent, or Firm* — Ohlandt, Greeley, Ruggiero & Perle, LLP

(57) ABSTRACT

A refrigerated display cabinet door includes inner and outer polygonal annular frames each formed as a single substantially homogenous polymeric/copolymeric injection molded member. An insulated glass unit is bonded to the inner and outer frames which are forcefully held together by a periphery snap fastening mechanism which avoids conventional use of clamps, vises or the like during adhesive cure/set-up. Conventional pivot pins carried by the display door are uniquely guided into pivot pin openings through guiding and locating members which can be snap-secured in openings of a frame in a display case.

8 Claims, 6 Drawing Sheets

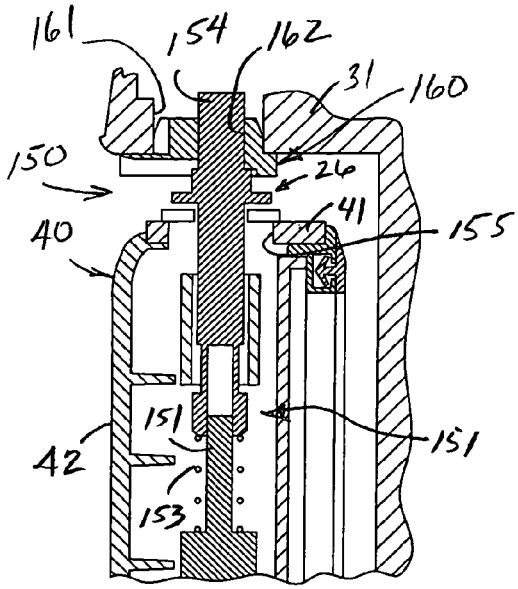
FIG. 8
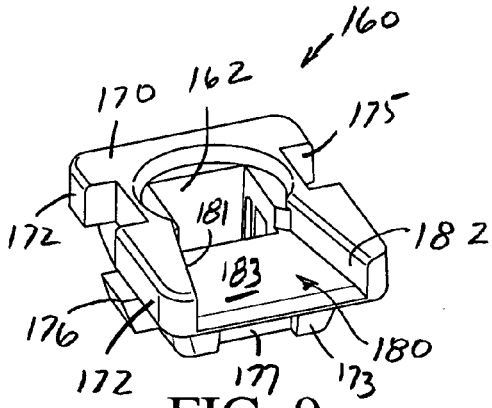
FIG. 9
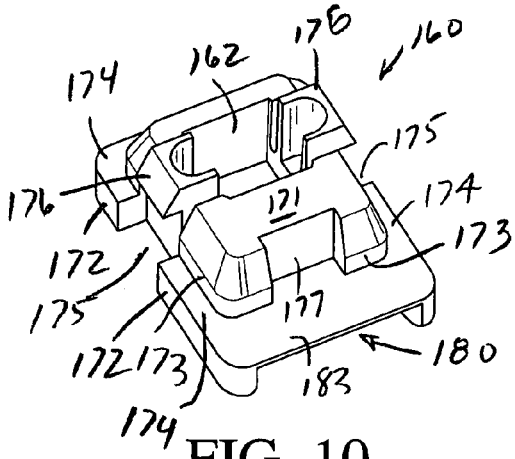
FIG. 10
FIG. 11
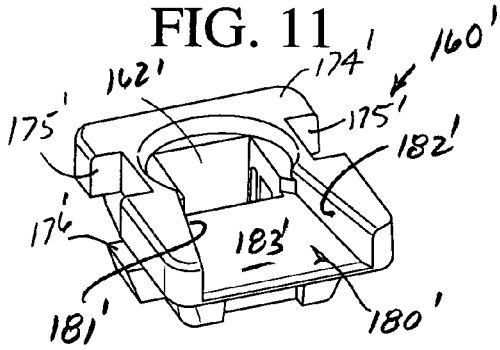
FIG. 12
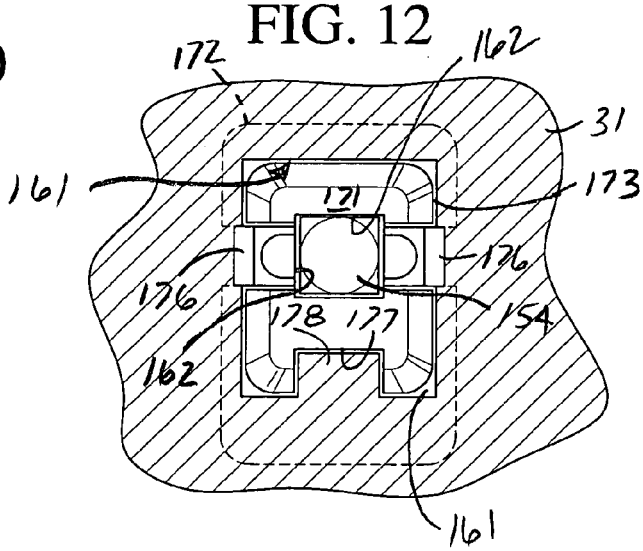

REFRIGERATED DISPLAY CASE DOOR

BACKGROUND OF THE INVENTION

The invention is directed to product display cabinets or cases which are used in self-service markets, stores, and other establishments in which products are displayed, viewed, selected and purchased. Such display cabinets generally operate below external ambient temperature. Typically such display cabinets include one or more glass paneled doors through which products on shelves in an interior compartment of the display case can be viewed.

Typically the closures or doors for such display cabinets include an insulated glass unit or assembly comprised of a plurality of glass panes disposed in substantially parallel side-by-side spaced relationship to each other. Normally spacers maintain the glass panes separated from each other and a peripheral seal unites the assembly into a unitized glass unit. Door frames for such glass units have been conventionally formed in many different ways. In accordance with U.S. Pat. No. 3,673,735 issued on Jul. 4, 1972 to Winsler et al., a door frame is made from a plurality of rectangularly related extrusions made from aluminum or some other suitable metal. Four pieces cut from one specific extrusion are mitered at the corners and are welded together to form an outer frame member, as are four pieces of a different extrusion to form an inner frame member, both of a generally open polygonal annular configuration. Obviously, such door frames are undesirable for use in refrigerated display cases because of the high heat conductivity of metal. More recently metal frames remain utilized in association with display doors for refrigerated display cases, but thermal insulating barrier members formed of molded, expanded or extruded plastic material are placed against the insulated glass unit to increase efficiency because the barrier members have relatively low heat conductivity. However, discounting use of a conventional peripheral gasket member, such display doors still utilize a metallic door frame made of four pieces of extruded metal mitered at the corners and welded to each other resulting in decreased heat conductivity, but increased production costs. Even in the case of a refrigerator door formed from polymeric material, such as disclosed in the patent to Richardson et al. granted on Jun. 8, 1999 under U.S. Pat. No. 5,910,083, the top, bottom and side rail elements are mitered at the corners and united thereat by bonding to form a generally polygonal annular door frame. However, for the most part such conventional insulated display cabinet doors are extremely complex in the manufacture and assembly thereof resulting in relatively high prices per door at both wholesale and retail levels.

Conventional doors for refrigerated display cabinets also generally carry upper and lower outwardly spring-biased pivot pins which enter pivot openings in the door frame of an associated display cabinet. Insulated doors are relatively heavy and aligning and inserting the pivot pins into the pivot openings can be difficult, particularly when the pivot pins are under relatively high biasing forces.

BRIEF SUMMARY OF THE INVENTION

The present invention is directed to a novel display cabinet and particularly to a closure or a door therefor which is defined by four major components, namely, an outer polygonal annular frame member, an insulated glass unit, an inner polygonal annular frame member and an inner polygonal peripheral seal.

In keeping with the present invention, the outer polygonal annular frame member is a single substantially homogeneous polymeric/copolymeric injection molded member, as is also the inner polygonal annular frame member. The latter construction of the inner and outer polygonal annular frame members reduce heat conductivity to an absolute minimum, thereby creating a display door which is highly efficient and relatively inexpensive to both manufacture and assemble, as will be more evident hereinafter.

More specifically, the one-piece injection molded polymeric/copolymeric outer frame or bezel is defined by radially inwardly directed inner and outer border portions or flanges and a peripheral wall therebetween with the inner and outer flanges setting-off respectively larger and smaller polygonal openings. The insulating glass unit is also polygonal and is of a peripheral size which can pass through the inner opening of the outer frame but cannot pass through the outer opening of the outer frame. When thus inserted into the outer frame, a peripheral bead of adhesive between an outer peripheral surface of the insulating glass unit and the outer flange of the outer frame effectively bonds the same together. A second bead of adhesive peripheral bonds an inner peripheral surface of the IG glass unit to an inner peripheral edge of the inner frame while an outermost edge portion of the inner frame is snap-secured to a flange of the outer frame to forcefully retain the components in assembled condition incident to the curing/solidification of the two adhesive beads. In this manner the door frame of the display door is made from only two major pieces of material each injection molded from polymeric/copolymeric material possessing low heat conductivity and through the utilization of two peripheral adhesive beads and a highly forceful peripheral snap connection between the inner and outer frames, the IG unit is held rigid until the adhesive of the two beads cures/sets.

The latter construction provides simplicity of assembly in a relatively short period of time absent extraneous components, such as separate fasteners, and utilizes a minimum of major components, namely, four components defined by the one piece injection molded outer frame, the one piece injection molded inner frame, the glass unit and the sealing member. Only two beads of adhesive applied during assembly retain the components securely bonded together to provide a relatively inexpensive and long-lasting insulated display door.

The display door just described also includes a pair of conventional pivot pins in substantially axially aligned relationship biased outwardly at upper and lower corners of the display door which engage in a pivot pin guiding and locating member of the invention associated with an opening in upper and lower walls of the display cabinet door frame. Each opening in the door frame is of specific configuration to accurately positionally locate therein the guiding and locating member which includes guide means for guiding each pivot pin into a pivot opening of the guiding/locating member. Since each pivot pin and guiding or locating member can be only connected to the display door frame in one position, each display door can be easily and accurately assembled by guiding each pivot pin between guiding surfaces of the guiding or guide member into each associated guide member pivot pin opening to assure that each display door is properly pivotably mounted with respect to the display cabinet.

With the above and other objects in view that will hereinafter appear, the nature of the invention will be more clearly understood by reference to the following detailed description, the appended claims and the several views illustrated in the accompanying drawings.

BRIEF DESCRIPTION OF THE SEVERAL VIEWS OF DRAWINGS

FIG. 8 is an enlarged cross-sectional view taken generally along line 8-8 of FIG. 7, and illustrates the manner in which a conventional spring biases the pivot pin into the pivot pin opening of the pivot pin guiding member.

FIG. 9 is a top perspective view of the pivot pin guide or guiding member, and illustrates a guide path defined by inwardly converging opposing side guide surfaces for directing a pivot pin into the pivot pin opening of the guide member.

FIG. 10 is a bottom perspective view of the guide member of FIG. 9, and illustrates oppositely projecting resilient fastening lugs and a locating slot in a forward peripheral face of a body of the guide member.

FIG. 11 is a top perspective view of another guide member, and illustrates an inwardly and upwardly tapering lower guide surface between inwardly converging opposing side guide surfaces.

FIG. 12 is fragmentary top plan view looking upwardly in FIG. 6, and illustrates a positional locating opening in an upper horizontal frame member defined in part by an inwardly projecting locating tab which registers with a positional locating slot of the guide member.

DESCRIPTION OF THE PREFERRED EMBODIMENT

Figure 1:
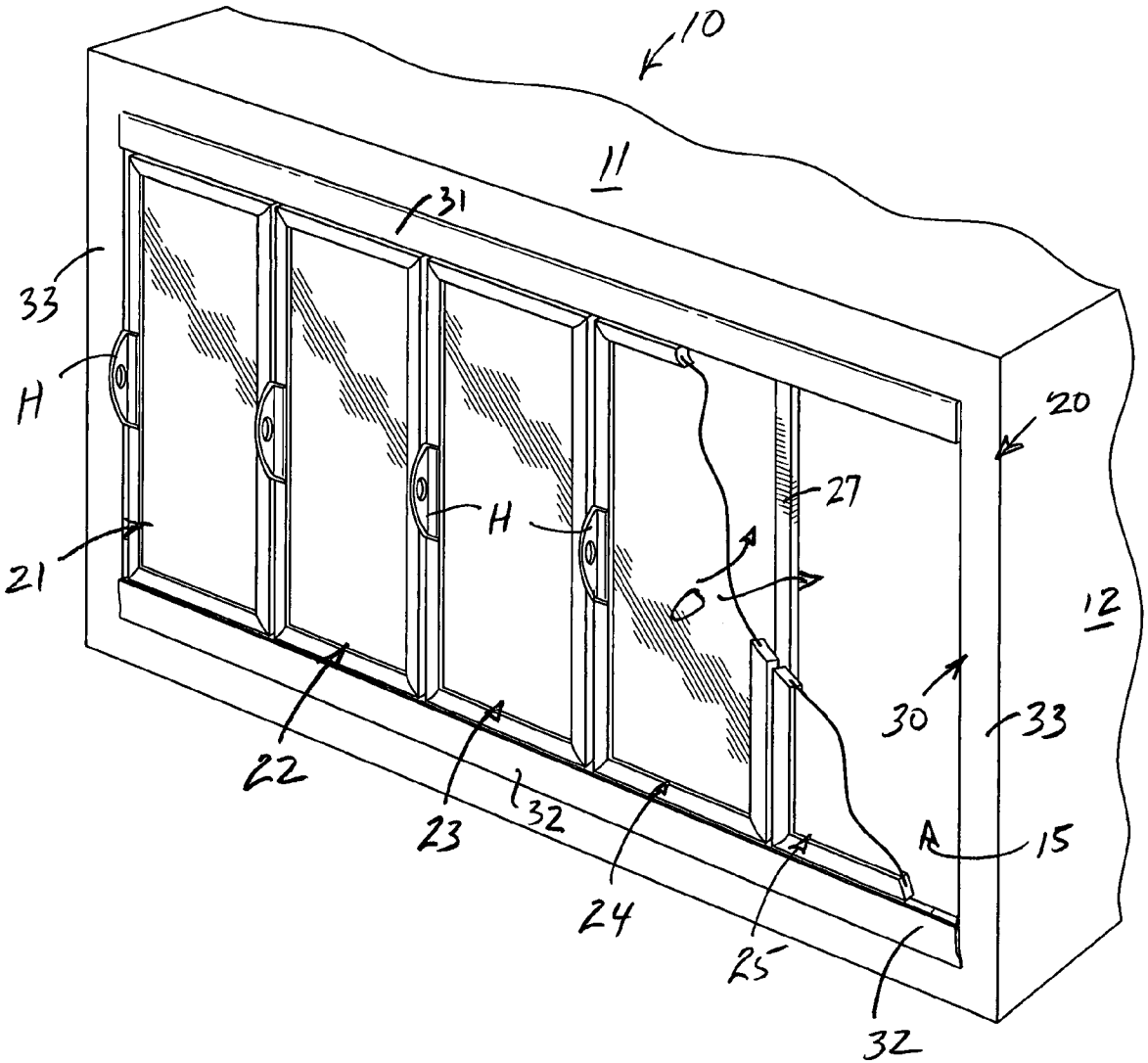
FIG. 1 is a front perspective view, and illustrates a display cabinet including a plurality of insulating glass doors, a door frame, one of several vertical mullions and an interior or interior chamber of the cabinet in which products are housed and displayed.

A novel refrigerated display cabinet, case, walk-in or the like is fully illustrated in FIG. 1 of the drawings, and is generally designated by the reference numeral 10.

The display cabinet 10 may be, for example, a self-contained refrigerated unit which, after manufacture, is shipped to a self-service store, market or like establishment in which perishable food items are stored on shelves (not shown) or the display cabinet 10 can be a so-called built-in by which the cabinet 10 can be framed-out at the use site. In either case, the display cabinet 10 includes a top wall 11 (FIG. 1), opposite substantially parallel side walls 12, of which only one is shown, and a bottom wall and a rear wall (not shown) collectively defining an interior product compartment or chamber 15 which is maintained below outside ambient temperature by a conventional cooling system (not shown).

Figure 5:
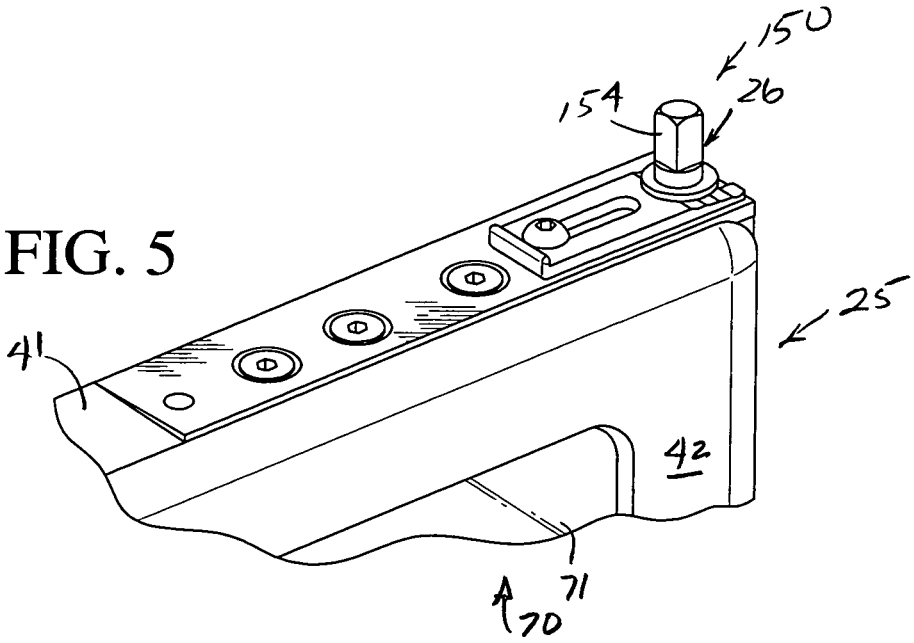
FIG. 5 is a fragmentary perspective view of a corner of one of the display doors, and illustrates a pivot pin projecting upwardly therefrom.
Figure 6:
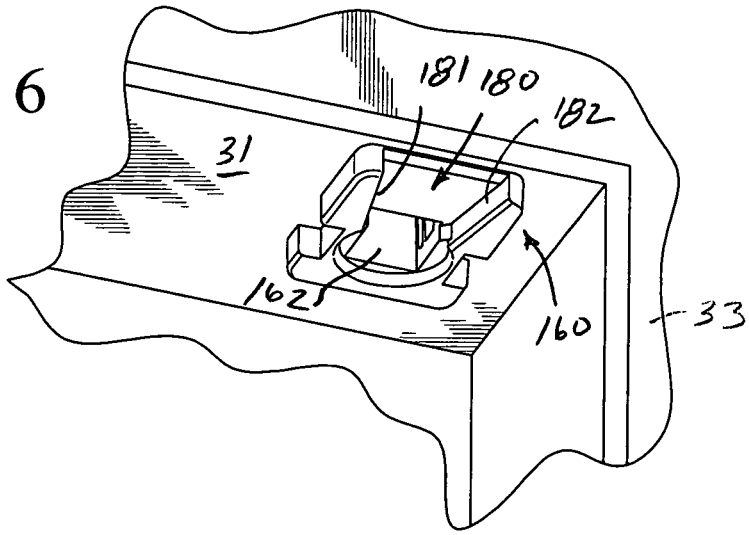
FIG. 6 is a fragmentary perspective view of the upper right-hand corner of the display cabinet frame of FIG. 1, and illustrates a pivot pin guiding and locating member snap-secured in an opening formed in a wall of the frame member.

A front of the display cabinet 10 includes a door frame and door assembly 20 which is generally of a polygonal configuration, as viewed from the front, and defines an opening (unnumbered) which is subdivided into a plurality of individual openings O by a plurality of substantially horizontally spaced vertical mullions 27. A door frame 30 of the door frame and door assembly 20 has pivotally mounted therein a plurality of IG glass panel doors 21-25, each identically constructed in accordance with the present invention and each including upper and lower vertical pivot pins 26 (FIG. 5) for pivoting each door 21-25 to respective upper and lower horizontal extruded metal frame members 31, 32 (FIGS. 1 and 6-8) of the frame 30 which also includes vertical extruded metal end frame members 33 and three additional substantially identical vertical mullions (not shown) corresponding to the mullion 27 illustrated in FIG. 1 of the drawings. Inboardmost walls (unnumbered) of the frame members/mullions 31-34 and 27 set-off five access openings O, one opening O associated with each door 21-25, through which products in the compartment 15 can be viewed and accessed.

Since the display doors 21-25 are identical, the following description of the display door 25 and its method of assembly/manufacture will be considered equally applicable to the display doors 21-24.

Figure 2:
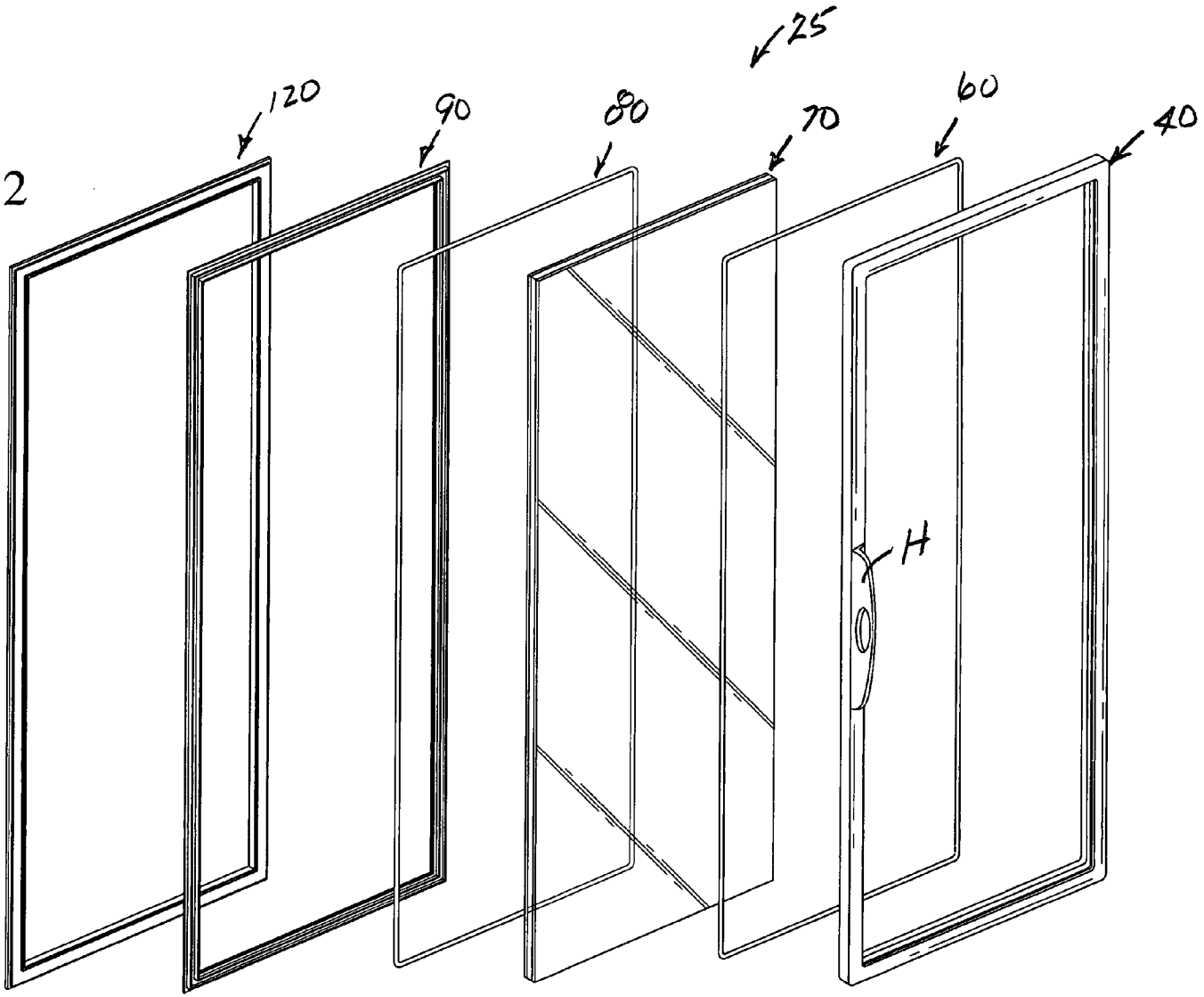
FIG. 2 is an exploded perspective view of the components used to manufacture each of the display doors of FIG. 1, and illustrates from right-to-left a polygonal annular outer frame, a polygonal bead of adhesive, an insulating glass unit or assembly, another polygonal bead of adhesive, a polygonal annular inner frame, and a polygonal sealing member.

The display door 25 (FIGS. 2, 3 and 4 of the drawings) includes an outer polygonal annular frame 40, a polygonal bead of bonding or adhesive material 60, an IG (insulating glass) unit or assembly 70, another polygonal bead of bonding material or adhesive 80, an inner annular polygonal frame 90 and an inner polygonal sealing member 120.

Of major importance with respect to the present invention is the fact that the outer polygonal annular frame 40, including a handle H thereof (FIGS. 1 and 2), is formed as a single substantially homogenous injection molded polymeric/copolymeric member which has heretofore been unprovided in refrigerated display cabinet IG doors. Of equal importance is the fact that the inner annular polygonal frame 90 is also formed as a single substantially homogeneous polymeric/copolymeric injection molded member. Because of the latter construction of the two frames 40, 90 and specific peripheral walls and relative dimensioning thereof with respect to each other and with respect to the IG unit 70, the display door 25 is essentially of a three-piece construction, namely, both frames 40, 90 and the IG unit 70 imaginatively rigidly bonded together by the strategic location of the peripheral beads of adhesive material 60, 80, as will be described more specifically hereinafter.

The outer polygonal frame 40 (FIGS. 3 and 4) of the display door 25 includes a peripheral wall 41 and an outermost or outer border portion or flange 42 directed inwardly and defining an outer polygonal opening Oo of a polygonal configuration. The outer frame 40 further includes an inner or innermost border portion or flange 43 projecting inwardly from the peripheral wall 41 and defining a polygonal inner opening Oi which is appreciably smaller in size than the outer polygonal opening Oo defined by the flange 42. The peripheral wall 41 and the inwardly directed border portions or flanges 42, 43 define an inwardly opening peripherally extending chamber 45 into which interiorly projects a peripherally extending reinforcing rib 46. A peripheral terminal end wall portion 47 of the peripheral wall 41 terminates in a peripheral terminal end face or surface 48 and defines with a substantially parallel peripheral wall 50 a continuous inwardly opening peripheral groove 51. The peripheral wall 50 also includes a terminal peripheral end wall portion 52 and outboard thereof a peripherally extending locking face or surface 53 in part defining cooperative snap-securing means 55 (FIG. 4) which is associated with the inner polygonal annular frame 90 in a manner to be described more fully hereinafter.

Figure 3:
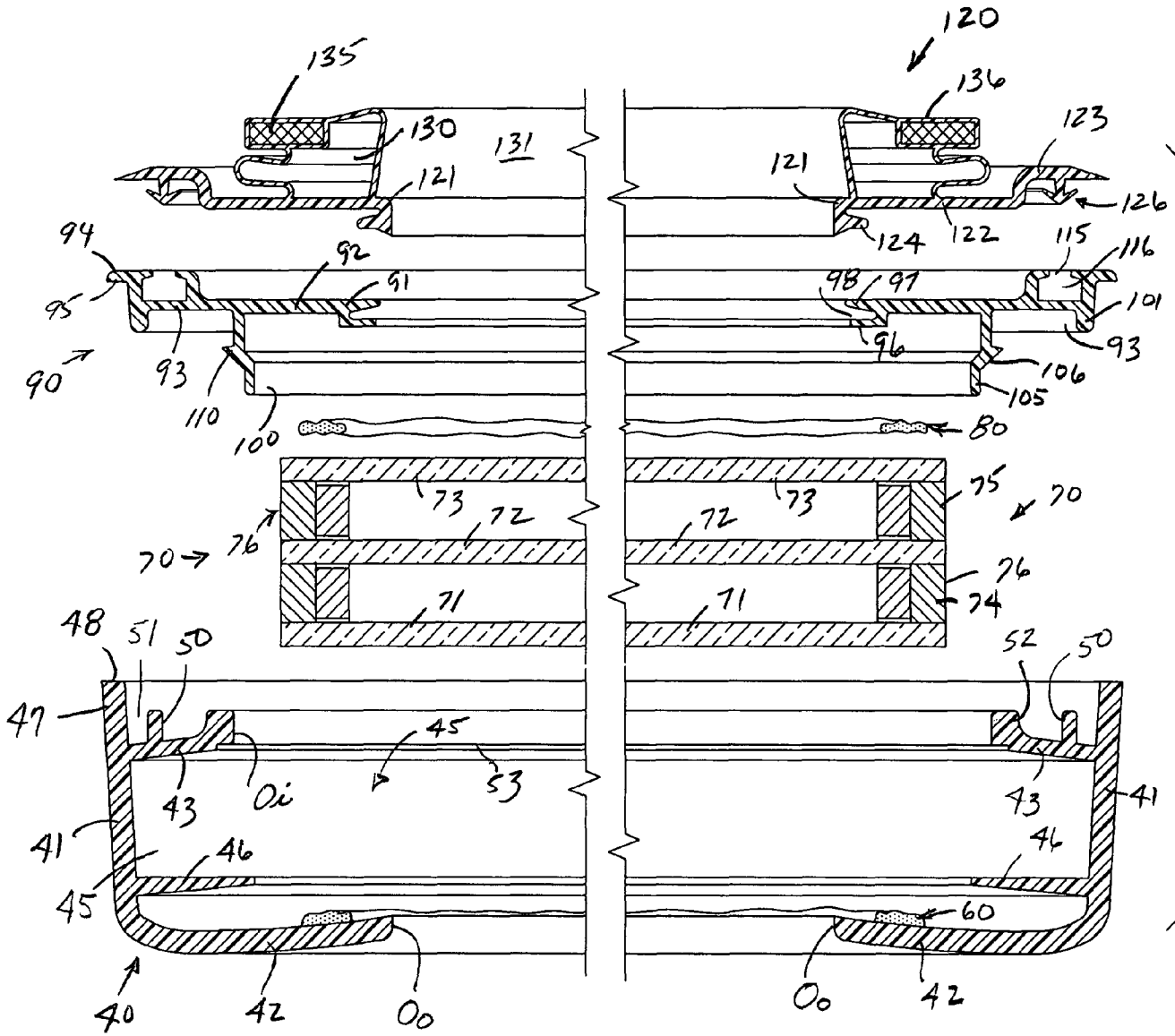
FIG. 3 is a fragmentary exploded cross-sectional view through the unassembled components of FIG. 2, and more specifically illustrates the cross-sectional configurations thereof and the relationships of the components to each other.

During assembly of the display door 25, the adhesive bead 60 (FIGS. 2, 3 and 4) is applied to an inner surface (unnumbered) of the flange 42 or to the IG unit or assembly 70 in the manner evident from FIG. 3 of the drawings. The adhesive of the adhesive bead 60 is quick setting, curing or drying (within one hour) which is highly desirable for purposes of assembly, as will be described more fully hereinafter.

The insulating glass unit or assembly 70 is also of a conventional construction and can include two, three or more pieces of tempered glass, such as tempered pieces of glass 71, 72 and 73 disposed in substantially spaced parallel relationship and retained thereat conventionally by spacers 74, 75 appropriately bonded and sealed to the glass pieces 71, 72; 72, 73 to produce an air-tight IG unit or assembly 70 which may include conventional infrared reflecting visible light transmitting coatings on one or more surfaces thereof, such as disclosed in U.S. Pat. No. 4,382,177 granted to James J. Heaney on May 3, 1983 and reissued under RE 35,120 on Dec. 12, 1995.

One or more of the inner surfaces (unnumbered) of the tempered glass pieces 71, 72 and/or 73 may include a metallic strip electrode electrically conductively bonded to an electric conductive coating on a surface of one of the glass pieces 71-73 to reduce/eliminate condensation and/or include a heating element associated with the outer frame 40 in the manner disclosed in U.S. Pat. No. 4,127,765 granted to James J. Heaney on Nov. 28, 1978. The insulating glass unit 70 includes an exterior peripheral polygonal surface 76 which corresponds in shape to the shapes of the openings Oo and Oi, but the peripheral dimensions in both length and width of the peripheral surface 76 are greater than like dimensions of the opening Oo of the flange 42 of the outer frame 40, but less than the dimensions of the opening Oi of the flange 43 of the outer frame 40. The function of the latter dimensioning is disclosed in the commonly assigned patent of Herrmann et al. granted on Apr. 20, 2004 under U.S. Pat. No. 6,722,083 B2. As more specifically described in the latter patent and evident in FIG. 3, the dimensioning of the peripheral surface 76 of the insulating glass unit 70 permits the insulating glass unit 70 to be introduced downwardly as viewed in FIG. 3 through the opening Oi of the peripheral flange 43 into the chamber 45 of the outer frame 40 to the position shown in FIG. 4 with the adhesive bead 60 bonding an inner surface (unnumbered) of the outer flange or border 42 to an outer surface (unnumbered) of the outer glass piece 71 during assembly of the display door 25, as will be described more fully hereinafter.

Figure 4:
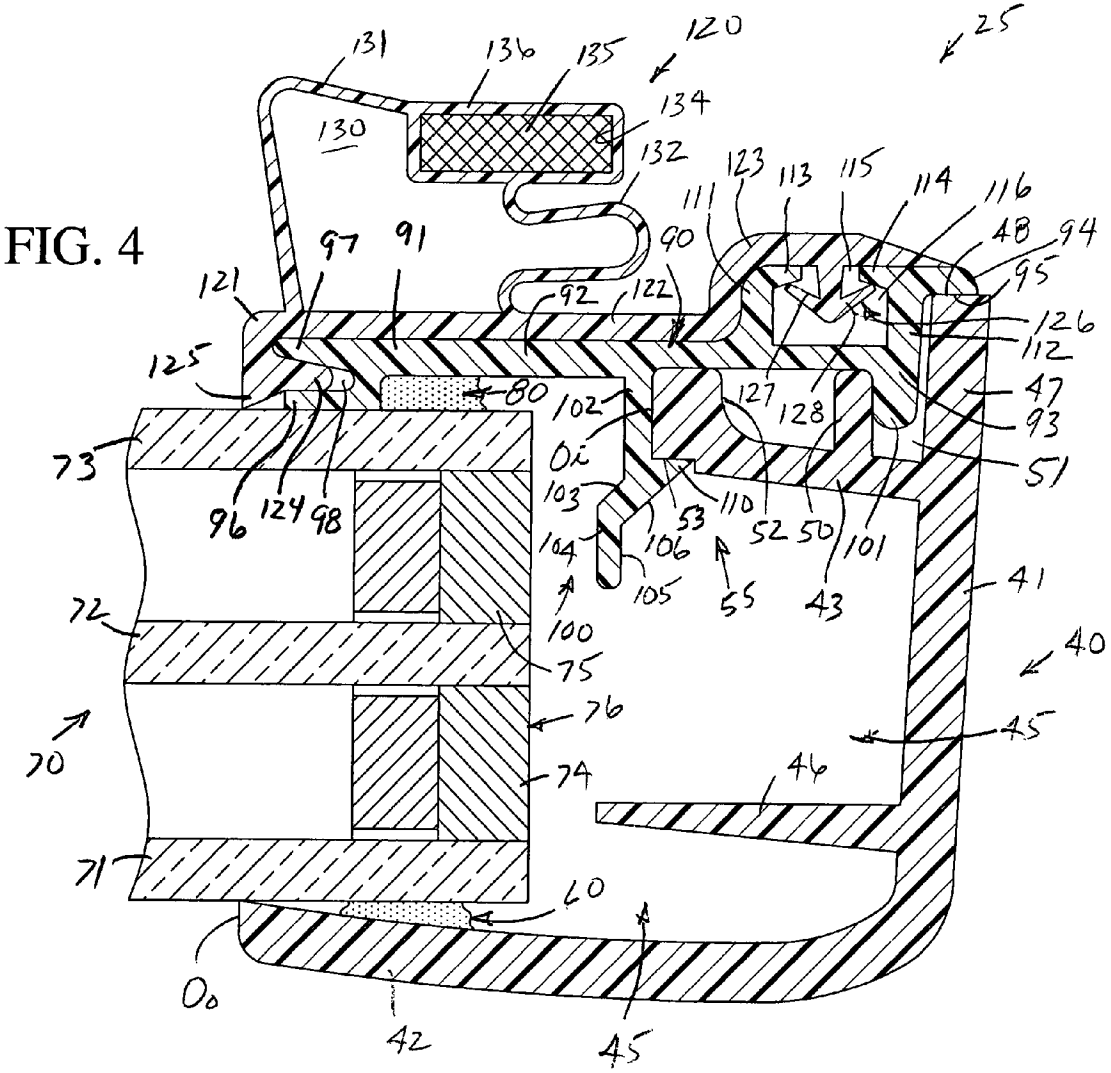
FIG. 4 is an enlarged cross-sectional view taken through any one of the display doors of FIG. 1 and the display components of FIG. 3 when fully assembled, and illustrates the components in assembled relationship.

The adhesive bead 80 (FIGS. 3 and 4) bonds an inner surface (unnumbered) of the inner polygonal annular frame 90 to an outer surface (unnumbered) of the piece of glass 73. More specifically, the inner frame 90 includes a first innermost polygonal peripheral portion 91, an intermediate peripheral wall portion 92 and an outermost peripheral portion 93 which terminates in an outwardly directed peripheral terminal wall portion 94 having a face or surface 95 in intimate bearing peripheral sealing relationship to the end face 48 of the terminal end wall portion 47 of the outer frame 40. The innermost peripheral wall portion 91 includes two inwardly directed relatively spaced peripheral leg portions 96, 97 defining therebetween an inwardly diverging peripheral groove 98. The peripheral leg portion 96 intimately sealingly engages an outer surface (unnumbered) of the glass piece 73 of the IG unit 70 to preclude exodus of the adhesive or bonding material of the adhesive bead 80 the left, as viewed in FIG. 4, and essentially retains the adhesive 80 positioned as shown in FIG. 4. The outermost peripheral wall portion 93 of the inner frame 90 includes two outwardly directed peripheral wall portions or flanges 100, 101, the latter of which seats in the inwardly directed peripheral groove 51 of the outer frame 40 and snugly engages in surface-to-surface contact with the peripheral wall 50 of the flange 43 along two surfaces (unnumbered) thereof, as is readily apparent in FIG. 4.

The peripheral flange 100 is stepped and includes an innermost wall portion 102, an inclined medial wall portion 103 and an outermost wall portion 104. The wall portions 104, 103 include respective outermost peripherally extending surfaces 105, 106 which collectively define a peripheral guide surface for introducing the peripheral flange 100 progressively into and through the opening Oi of the peripheral flange 43 of the outer frame 40 until the peripheral flange 100 reaches its fully assembled and seated position, as shown in FIG. 4. The guide surface 105 of the peripheral end portion 104 of the peripheral flange 100 is of a smaller peripheral dimension than the dimension of the opening Oi while the peripheral guide surface 106 progressively increases in peripheral size until reaching a snap-locking peripheral nose 110 forming the second part of the snap-securing means 55 which eventually intimately engages the locking face or surface 53 of the peripheral flange 43 of the outer frame 40 under sufficient force to draw the flange or border 42 of the outer frame 40 and the inner frame 90 toward each other under the appreciably high resilient force of the plastic material of the outer and inner frames 40, 90, respectively, in particular the force created between the respective peripheral wall portions 43, 102 thereof. This peripheral force particularly draws the flange 42 of the outer frame 40 and the innermost peripheral wall portion 91 of the inner frame 90 into intimate forceful contact with the outer surfaces (unnumbered) of the respective glass pieces 71, 73 squeezing the adhesive beads 60, 80, respectively, into intimate contact with all opposing peripheral surfaces to create a very strong bond once the adhesive of the adhesive beads 60, 80 has cured or set. The snap-securing means 50 thereby automatically creates a very strong or forceful clamping force which holds the components 40, 70, 90 assembled absent the use of conventional clamps, vises or the like, and when fully assembled by applying the inner polygonal sealing member 120 thereto, very quickly and easily, the display door 25 can be shipped very shortly after the adhesive beads 60, 80 have been applied and well before curing thereof which allows packaging and shipping to continue quickly and inexpensively. It should also be particularly noted that there are six peripheral areas of contact between the outer and inner frames 40, 90 and the glass unit 70, namely, at the surfaces 48, 95; the two surface contacts between the peripheral walls 50, 101; the two peripheral surface contacts between the terminal peripheral wall portion 52 of the flange 43 and each of the adjacent peripheral surfaces of the flange portion 102 and the intermediate peripheral wall portion 92 of the inner frame, and the surface contact between the leg 96 and the outer surface of the piece of glass 73. The latter six peripheral surfaces of contact render the entire door extremely robust and rigidly united, including the formation of a very tight seal between the peripheral surfaces or faces 48, 95 (FIG. 4) to substantially seal the chamber 45 to atmosphere and reduce ambient air entry into the chamber 45 to thereby increase cooling efficiency when associated with the display case 10.

The outer peripheral wall portion 93 of the inner frame 90 includes two inwardly directed peripheral flanges 111, 112 terminating in opposing noses 113, 114 defining therebetween a peripheral slot 115 and a wider peripheral chamber 116 which function in a manner to be described more fully hereinafter with respect to the inner polygonal sealing member or sealing means 120.

The inner polygonal sealing member or sealing means 120 includes an innermost or inner peripheral wall portion 121, a medial peripheral wall portion 122 and an outer or outermost peripheral wall portion 123. The inner peripheral wall portion 121 includes an outwardly directed peripheral nose 124 converging outwardly which is received in the groove 98 of the inner peripheral wall portion 91 of the inner frame 90 and also includes a peripheral sealing edge 125 which intimately engages the outer surface (unnumbered) of the glass piece 73 to provide aesthetic appearance thereat. The opposite outer peripheral wall portion 123 of the inner polygonal sealing member 120 includes a peripheral outwardly directed securing flange 126 of a generally T-shaped transverse cross-section, whose arms 127, 128 resilient lockingly engage against the undersides of the noses 113, 114, respectively, to hold the inner polygonal sealing member 120 intimately secured to the inner frame 90. The medial portion 122 of the inner polygonal sealing member 120 includes a hollow chamber 130 defined by resilient peripheral walls 131, 132 which merge and define another annular chamber 134 housing conventional magnetic means 135 which are substantially polygonal in cross-section and with a relatively flat peripheral wall portion 136 magnetically secure the doors 21-25 closed through magnetic attraction relative to the various metal frame members and mullions 27, 33 of the frame 30 (FIG. 1) in a conventional manner.

The display door 25 and each of the remaining display doors 21-24 can either be left-hand or right-hand openings and, in each case, upper and lower corners (unnumbered) of the doors are provided with conventional pivot means 150 (FIGS. 5-8) which can conventionally include a torsion rod or torque rod 151, the pivot pin 26, a spring 153 for at all times urging a square pin end portion 154 of the pivot pin 26 outwardly of the outer frame 40 through an opening 155 in the peripheral wall 41 (FIG. 8). The pivot means or pivot assembly 150 thus far described is relatively conventional but, in keeping with this invention, there is associated with each pivot pin end portion 154 pivot pin guiding and locating means 160 snap-secured in an opening 161 (FIG. 12) in each of the upper and lower frame members 31, 32, respectively, for guidingly locating the pin end portion 154 into a polygonal or rectangular opening 162 of the guiding means 160 to ease the assembly of each display door 21-25 relative to the frame 30.

Figure 7:
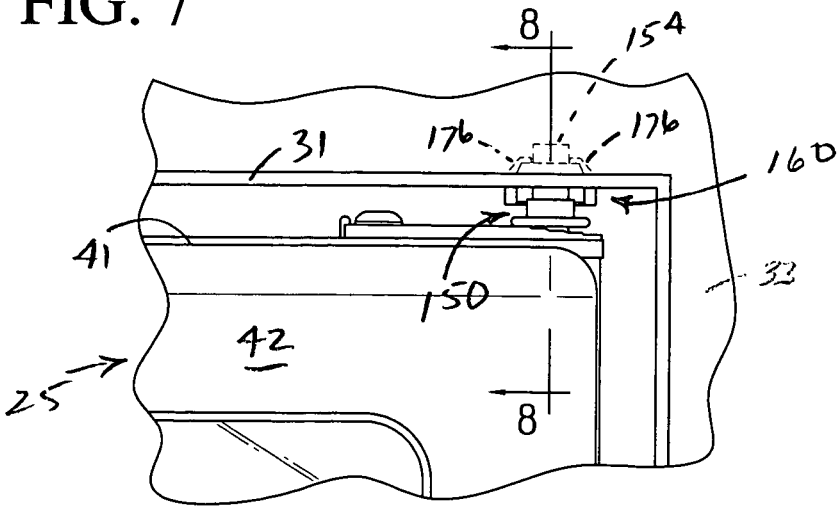
FIG. 7 is a fragmentary front elevational view of the upper right-hand corner of the display cabinet of FIG. 1, and illustrates the pivot pin of the display door located in a pivot pin opening of the pivot pin guiding member.

The guide member 160 includes a top surface 170 (FIG. 9), an opposite bottom surface 171 (FIG. 10), and outer peripheral surfaces 172, 173 which are stepped relative to each other with the surface 172 being larger than the surface 173 and thereby defining a peripheral flange 174. The flange 174 is interrupted by diametrically oppositely opening slots 175 and aligned therewith are oppositely directed resilient locking legs, lugs or noses 176. The smaller peripheral surface 173 is provided with a slot 177 which in part defines positional locating means to accurately locate each guide member 160 with its associated opening 161 (FIG. 12) by engaging and interlocking with a tab 178 of the associated frame 31 projecting into the opening 161. Stated otherwise, the configuration of the opening 161 (FIG. 12) including the tab 178 substantially mirrors the configuration of the peripheral surface 173 and the slot 177 which assures that each guide member 160 can be snapped into an associated opening 161 of the frame 30 only in one specific position. The specific position is such that a guide path 180 defined by converging guide surfaces 181, 182 converges in a direction toward the interior of the display cabinet 10 and/or the compartment 15 thereof. The locking lugs 176, 176 snap engage the frame 31 at opposite sides of the opening 161 to firmly secure the guiding means 160 in each associated opening 161 (FIGS. 7 and 12).

In order to assemble the display door 25 relative to the frame 30, one of the guide members 160 is snap-secured into each of the openings 161 which are positioned in vertically aligned relationship in the respective horizontal frame members 31, 32. Because of the single positional location provided by the means 177, 178 (FIG. 12), each guide member 160 is positioned such that the guide path or guide surface 180 not only converges toward the interior of the display cabinet 10 but also converges toward and terminates at the polygonal opening 162. With the display door 25 substantially vertical, its lower pin end portion (not shown) can be readily guided along the guide path 180 into the polygonal hole 162. The more difficult problem heretofore unprovided for in the prior art is guiding the upper pin end portion 154 of the upper pivot pin 26 into the polygonal opening 162 of the upper guide member 160. However, since the guide surface 181, 182 are relatively wide remote from the polygonal opening 162 (FIG. 6), the pin end portion 154 is easily guided between the guide surfaces 181, 182 and when pushed forwardly, the latter surfaces guide the pivot pin end portion 154 into alignment with the opening 162 at which time the spring 153 (FIG. 8) biases the pivot pin 26 upwardly to urge the pivot pin end portion 154 into the opening 162 (FIG. 8). A wall 183 (FIG. 9) spanning the distance between the converging guide surfaces 181, 182 is very thin and presents little problem with respect to pushing the pin end portion 154 beyond the entrance edge (unnumbered) of the thin wall 183 toward the pivot pin opening 162. The thickness in the front portion of the thin wall or surface 183 is best illustrated in FIG. 10 and, if desired, the portion thereof between the peripheral walls 172, 173 can be removed while retaining the guide surfaces 181, 182 in their entirety. Alternatively, the equivalent surface or wall 183' of another guide member 160' can be instead progressively tapered upwardly, as shown in FIG. 11, from its outer edge (unnumbered) inwardly toward a pivot pin opening 162' to progressively compress the spring 153 upon the introduction of the pivot pin 154 along the guide path 180' which upon entering the opening 162' will do so more readily because of the increased force created by the spring 153.

Although a preferred embodiment of the invention has been specifically illustrated and described herein, it is to be understood that minor variations may be made in the apparatus without departing from the spirit and scope of the invention, as defined by the appended claims.

What is claimed is:

1. A closure for a climate controlled compartment comprising:

a plastic annular inner open frame that is substantially polygonal;

a plastic annular outer open frame that is substantially polygonal and is a single substantially homogeneous injection molded member, wherein said inner open frame defines an inner substantially polygonal border portion and said outer open frame defines an outer substantially polygonal border portion, and wherein said outer open frame defines inner and outer substantially polygonal openings;

a substantially polygonal glass assembly having a peripheral edge portion located between said inner polygonal border portion and said outer polygonal border portion and within said inner polygonal opening in said outer open frame, wherein said glass assembly includes a plurality of pieces of glass in spaced relationship to each other;

a first bead of adhesive and a second bead of adhesive each peripherally bonding a respective one of said inner open frame and said outer open frame to a respective one of said plurality of pieces of glass of said glass assembly along said peripheral edge portion, such that each of said inner open frame and said outer open frame overlap and contact said respective one of said plurality of pieces of glass along said peripheral edge portion of said glass assembly and sandwich said peripheral edge portion therebetween; and first and second securing devices, wherein said inner open frame includes a peripheral wall and said outer open frame includes a peripheral wall, said peripheral walls collectively defining a chamber with said glass assembly, each said peripheral wall comprising a flange projecting into said chamber, wherein said first and second securing devices are associated with said inner and outer frame flanges, respectively, and inter-engage with each other to secure said inner and outer open frames to each other to substantially immobilize said inner open frame with respect to said outer open frame incident to curing of said first and second beads of adhesive.

2. The closure as defined in claim 1 wherein said outer open frame includes a handle as an integral substantially homogeneous plastic injection molded portion of said outer open frame.

3. The closure as defined in claim 1, further comprising a peripheral seal substantially continuously bordering said inner open frame, and cooperative devices for securing said peripheral seal to said inner open frame.

4. The closure as defined in claim 1, further comprising a peripheral sealing member substantially continuously bordering said inner open frame, said peripheral sealing member including inner and outer surface portions and peripheral edge portions, and said inner frame and said peripheral sealing member outer surface portion each having at least one securing device for securing said peripheral sealing member to said inner open frame.

5. The closure as defined in claim 4, wherein said outer open frame includes a handle as an integral substantially homogeneous plastic injection molded portion of said outer open frame.

6. The closure as defined in claim 1, wherein at least one of said first and second securing devices comprises a nose.

7. The closure as defined in claim 1, wherein said plastic annular inner open frame is a single substantially homogeneous injection molded member.

8. The closure as defined in claim 1, wherein said inner open frame sealingly engages said respective one of said plurality of pieces of glass.

* * * * *